US009857147B2

(12) United States Patent
Drummond

(10) Patent No.: US 9,857,147 B2
(45) Date of Patent: Jan. 2, 2018

(54) RAIL SYSTEM FOR A RIFLE

(71) Applicant: David Drummond, Maple Ridge (CA)

(72) Inventor: David Drummond, Maple Ridge (CA)

( * ) Notice: Subject to any disclaimer, the term of this patent is extended or adjusted under 35 U.S.C. 154(b) by 115 days.

(21) Appl. No.: 14/638,986

(22) Filed: Mar. 4, 2015

(65) Prior Publication Data

US 2016/0258714 A1 Sep. 8, 2016

(51) Int. Cl.
*F41C 23/00* (2006.01)
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS

| | | | | |
|---|---|---|---|---|
| 5,669,171 | A | 9/1997 | Sally | |
| 5,941,006 | A * | 8/1999 | Horton | F41G 11/002 42/124 |
| 6,752,137 | B2 | 6/2004 | Brunette et al. | |
| RE39,465 | E | 1/2007 | Swan | |
| D578,177 | S * | 10/2008 | Norberg | D22/110 |
| 7,716,865 | B2 | 5/2010 | Daniel et al. | |
| D632,753 | S * | 2/2011 | Leighton | D22/109 |
| 7,913,439 | B2 | 3/2011 | Whaley | |
| 8,205,373 | B1 | 6/2012 | Ubl et al. | |
| 8,240,075 | B1 | 8/2012 | Mullin | |
| D670,552 | S * | 11/2012 | Meeks | D8/301 |
| 8,307,750 | B2 | 11/2012 | Vuksanovich et al. | |
| 8,484,877 | B2 | 7/2013 | Zimmerman | |
| D703,286 | S | 4/2014 | Chen et al. | |
| 8,713,838 | B2 | 5/2014 | Ubl et al. | |
| 9,151,575 | B2 | 10/2015 | Pereira | |
| 2004/0000083 | A1 | 1/2004 | Grant, Jr. | |
| 2005/0252060 | A1 | 11/2005 | Gonzalez | |
| 2006/0236582 | A1 | 10/2006 | Lewis et al. | |
| 2007/0271834 | A1 | 11/2007 | Keng | |
| 2009/0077855 | A1 | 3/2009 | Pritchett | |
| 2010/0126054 | A1 | 5/2010 | Daniel et al. | |
| 2010/0162604 | A1 | 7/2010 | Dubois | |

(Continued)

FOREIGN PATENT DOCUMENTS

| | | |
|---|---|---|
| EP | 1716384 | 11/2008 |
| WO | 2015012895 | 1/2015 |

OTHER PUBLICATIONS

RSI K31 Scope Mount. <http://theswissriflesdotcommessageboard.yuku.com/topic/7223/Rock-Solid-scope-mount#.WNVqJU0zXCN>. Dec. 3, 2009.*

(Continued)

*Primary Examiner* — Gabriel Klein
(74) *Attorney, Agent, or Firm* — Cameron IP

(57) ABSTRACT

There is accordingly provided a rail system selectively connectable to a rifle. The rifle has a loading port for receiving bullets therein. The system includes a first rail positioned forward of the loading port. The system includes a second rail extending substantially parallel to the first rail and positioned rearward of the loading port. The system includes an aperture interposed between the first and second rails. The aperture is positioned to align with the loading port of the rifle. The system includes an elongate side member connecting the rails together.

20 Claims, 11 Drawing Sheets

(56) References Cited

U.S. PATENT DOCUMENTS

| | | | | |
|---|---|---|---|---|
| 2010/0186278 | A1 | 7/2010 | Daniel | |
| 2011/0107644 | A1* | 5/2011 | Faifer | F41C 23/04 42/75.02 |
| 2013/0031820 | A1 | 2/2013 | Deros | |
| 2013/0118051 | A1* | 5/2013 | Baker | F41G 11/003 42/90 |
| 2013/0180145 | A1* | 7/2013 | Behling | F41A 3/66 42/16 |
| 2013/0205634 | A1 | 8/2013 | Langevin et al. | |
| 2014/0068994 | A1* | 3/2014 | Schultz | F41G 11/003 42/124 |
| 2015/0027024 | A1* | 1/2015 | Pereira | F41G 11/004 42/90 |

OTHER PUBLICATIONS

Various rail system drawings and photos disclosing a rail system first made public on Mar. 9, 2013, in Chilliwack, BC, Canada at the Chilliwack Gun Show.
English Abstract of EP1716384.

* cited by examiner

RAIL SYSTEM FOR A RIFLE

BACKGROUND OF THE INVENTION

Field of the Invention

There is provided a system for a rifle. In particular, there is provided a rail system for a rifle.

Description of the Related Art

Rail systems for coupling accessories to rifles are known per se. On the one hand, some systems are relatively complicated and require many parts to function. This may increase manufacturing costs and add weight to the rifle, for example.

On the other hand, other systems may be relatively simple and may limit a user's ability to customize his or her rifle. Still other systems may hinder the operation of other features of the rifle.

There is accordingly a need for an improved rail system for a rifle which may be relatively inexpensive to manufacture, while still providing a variety of customization options to the user and without unduly hindering other desirable features and operations of the rifle.

BRIEF SUMMARY OF INVENTION

There is provided an improved rail system for a rifle disclosed herein that overcomes the above disadvantages.

There is accordingly provided a rail system selectively connectable to a rifle. The rifle has a loading port for receiving bullets therein. The system includes a first rail positioned forward of the loading port. The system includes a second rail extending substantially parallel to the first rail and positioned rearward of the loading port. The system includes an aperture interposed between the first and second rails. The aperture is positioned to align with the loading port of the rifle. The system includes an elongate side member connecting the rails together.

There is also provided a rail system selectively connectable to a rifle. The rifle has a loading port for receiving bullets therein. The system has a rearward end and a forward end which is spaced-apart from the rearward end. The system has a substantially open bottom and a substantially closed top which is spaced-apart from the bottom. The top and the bottom of the system extend between the ends thereof. The system has a pair of spaced-apart sides extending between the ends thereof and extending between the bottom and the top. A first one of the sides is substantially closed and a second one of the sides is substantially open. The system includes a pair of spaced-apart rails extending along the top of the system. The first one of the sides of the system couples the rails together. The system includes an aperture interposed between the rails. The aperture of the system is coextensive with the loading port of the rifle.

There is further provided a rail system selectively connectable to a rear sight receptacle of a rifle. The rifle includes a loading port for receiving bullets therein. The system has a protruding portion at a forward end thereof. The protruding portion is shaped to fit within the rear sight receptacle. The system further includes a top rail. The top rail has a rearward end positioned forward of the loading port. The top rail has a tapered forward end spaced-apart from the rearward end of the top rail. The protruding portion of the system couples to and extends outwards from the tapered forward end of the rail.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
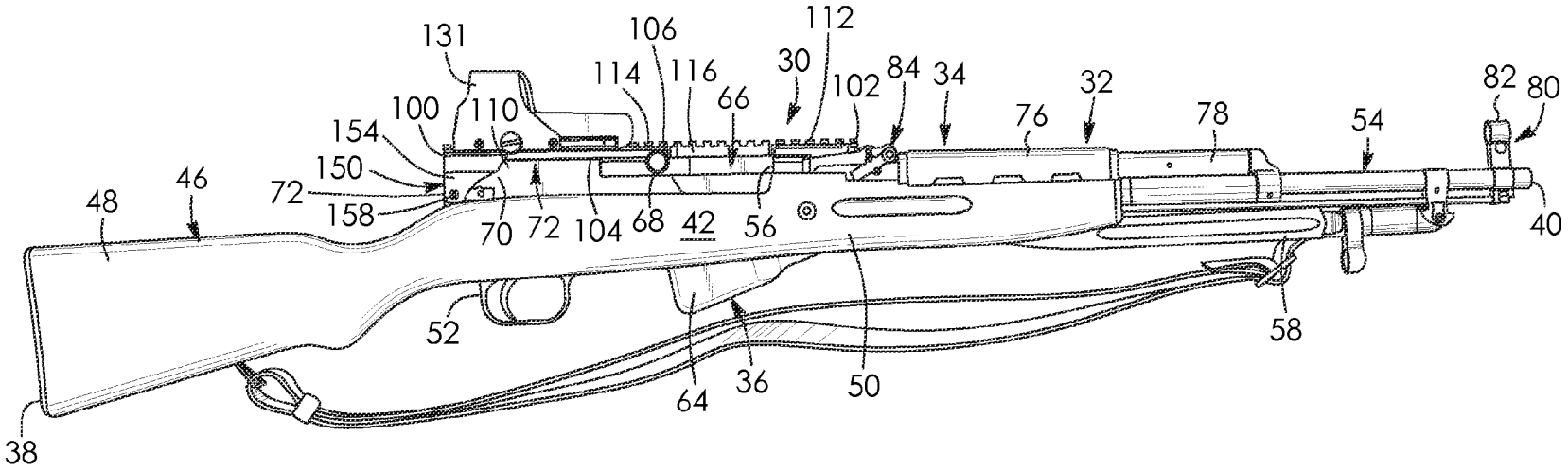
FIG. 1 is a first side elevation view of a rifle and a rail system connected thereto according to a first aspect.

Referring to the drawings and first to FIG. 1, there is shown a rail system 30 selectively connectable to a rifle 32. The rifle in this example is a semi-automatic rifle, in this example an SKS model Soviet semi-automatic carbine. However, this is not strictly required and the rail systems described herein may be used on other types of rifles.

Figure 2:
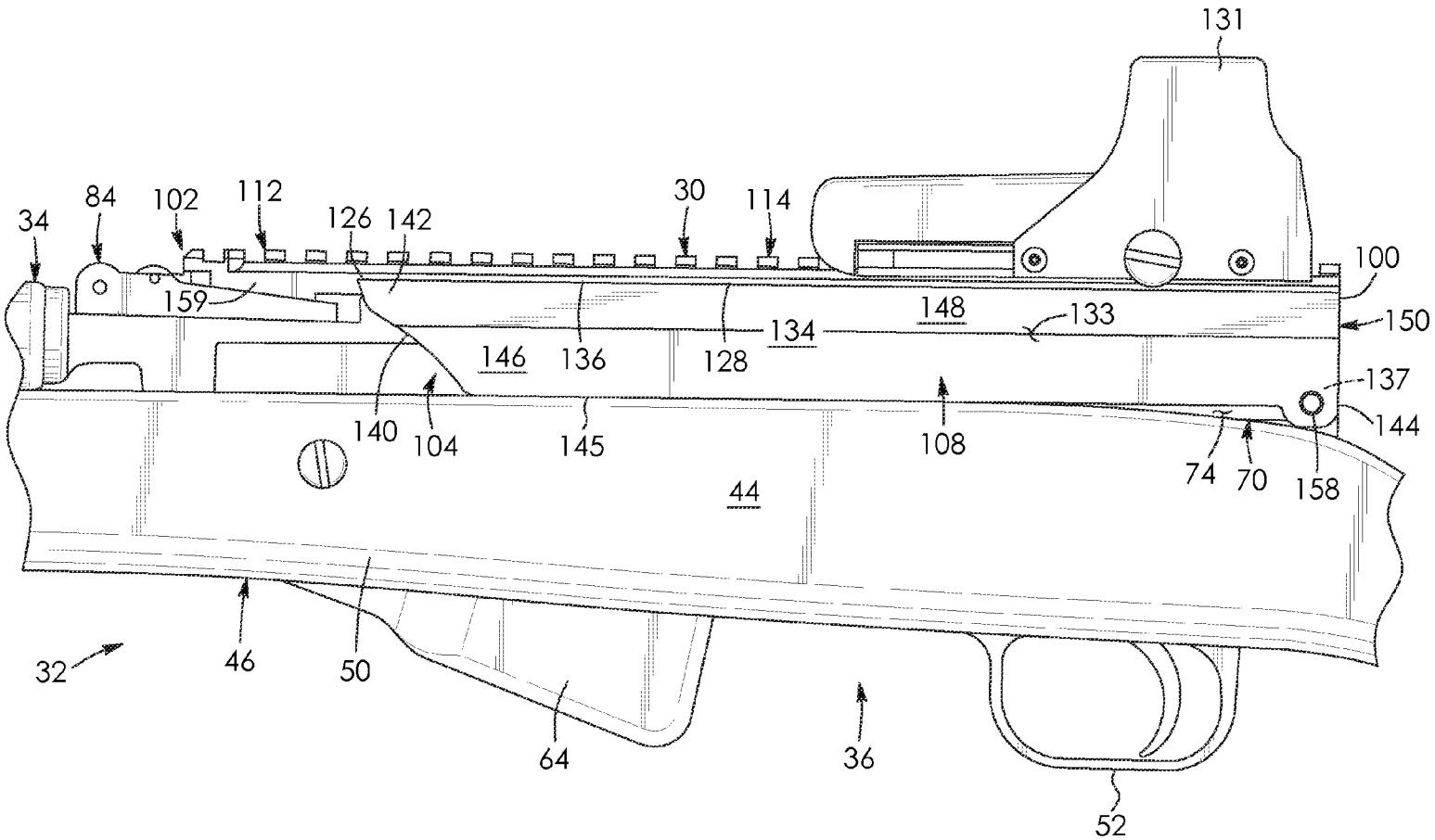
FIG. 2 is an enlarged second side elevation view of the rifle and the rail system of FIG. 1, the rifle being shown in fragment.

The rifle 32 has a top 34, a bottom 36 opposite the top, a rear, butt end 38, a front or muzzle end 40 which is spaced-apart from the butt end, a first side 42 and a second side 44 seen in FIG. 2 and which is spaced-apart from the first side thereof. The top, bottom and sides of the rifle extend between the ends 38 and 40 of the rifle. The sides 42 and 44 of the rifle 32 extend between the top 34 and bottom 36 of the rifle.

Referring back to FIG. 1, the rifle has a stock 46 including a main stock 48 extending from butt end 38 towards the muzzle end 40 of the riffle. The stock further includes a handguard or forestock 50 between the main stock and muzzle end of the rifle and located by the bottom 36 of the rifle. The rifle 32 includes a trigger assembly 52 coupled to the stock 46 adjacent to the bottom of the rifle. The rifle includes a barrel 54, which extends from a breech end 56 thereof located adjacent to the top 34 of the rifle above the forestock 50, to the muzzle end 40 of the rifle. A bayonet 58 extends below the barrel in this example adjacent to muzzle end 40 and is selectively coupled to the forestock.

Figure 10:
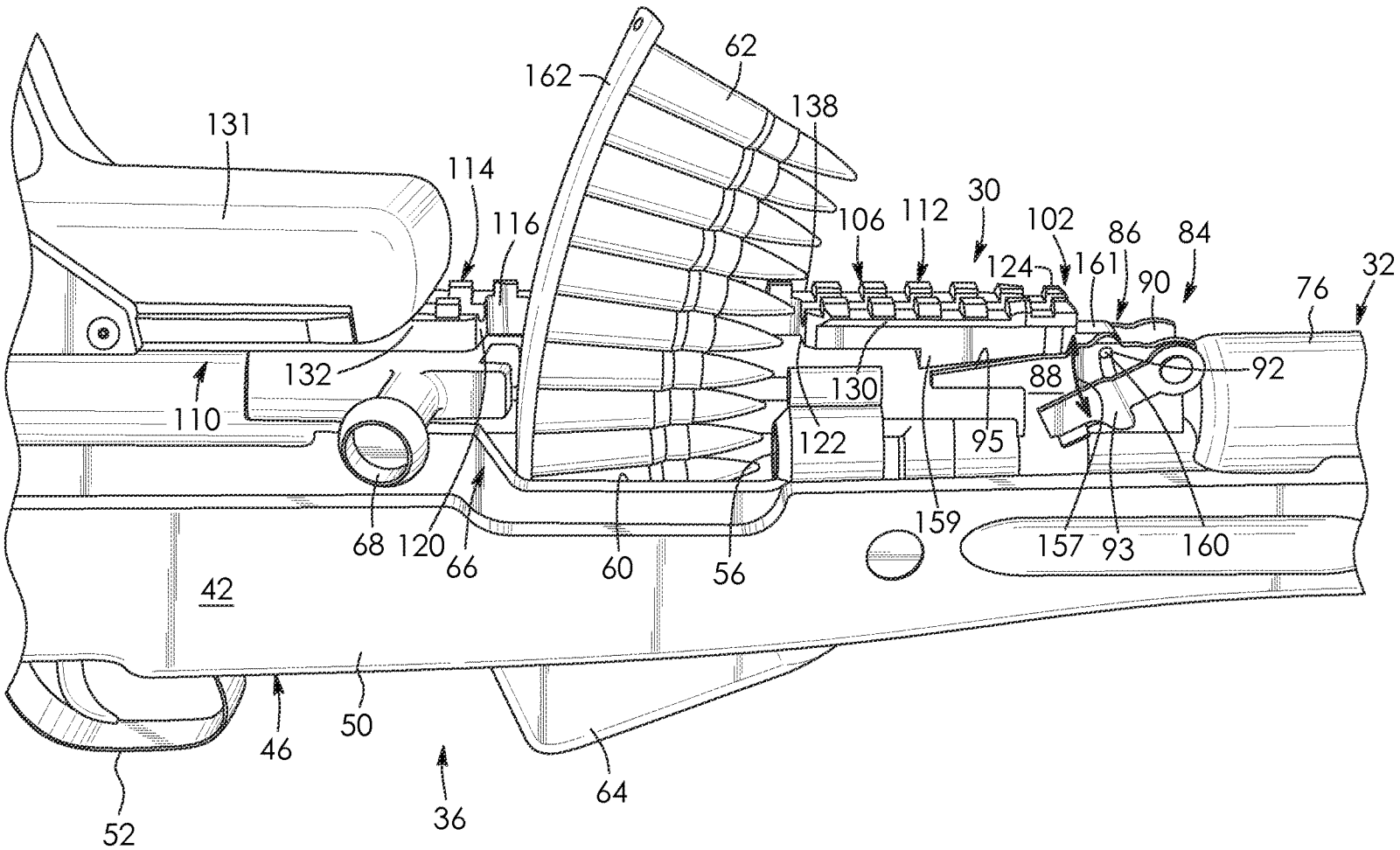
FIG. 10 is a top, first side perspective view of the rifle and the rail system of FIG. 1, with the rifle and the rail system shown in fragment, and further showing a stripper clip, and a plurality of cartridges coupled together by the stripper clip, the stripper clip being inserted within a loading port of the rifle.
Figure 11:
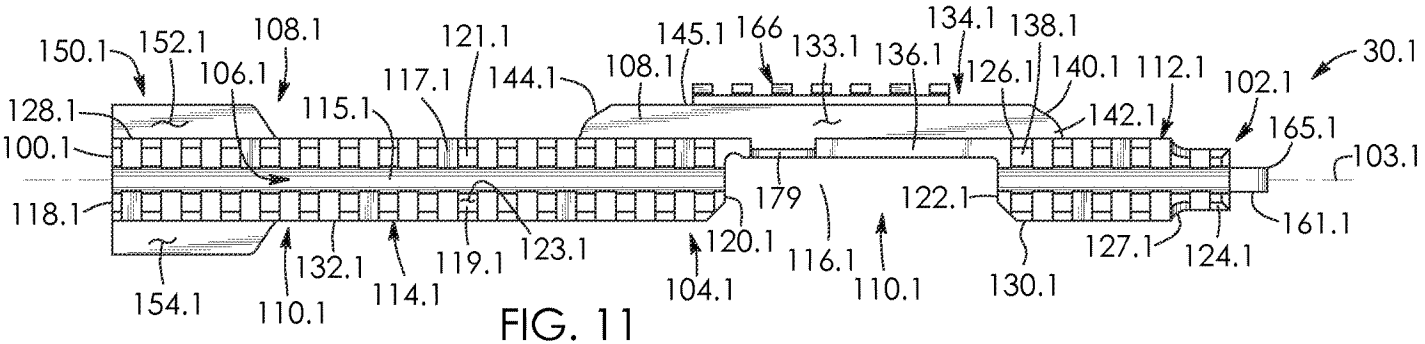
FIG. 11 is a top perspective view of a rail system for a rifle, the rail system being according to a second aspect.

As seen in FIG. 10, the rifle 32 further includes a loading port 60 for receiving bullets 62 therein. The loading port is located adjacent to the top 34 of the rifle and is to breech end 56 of the barrel 54. The rifle further includes a magazine assembly 64 located adjacent to the bottom 36 thereof for storing bullets therein. The magazine assembly is positioned forward of the trigger assembly 52, extends downwards from the forestock 50 and is in communication with the loading port for receiving bullets therefrom.

As seen in FIG. 1, the rifle 32 includes an action 66. The action includes a bolt carrier 68 which is moveable from a rearward position seen in FIG. 1 to a forward position seen in FIG. 9. The bolt carrier extends along the top 34 of the rifle and extends across the loading port 60 of the rifle in its forward position.

The rifle 32 has a top cover 70 which extends along and downwards from the top 34 thereof. The top cover of the rifle is coupled to the mainstock 48 and is located above the trigger assembly 52 and rearward of the bolt carrier 68. The top cover 70 may be u-shaped in profile and have a first side 72 extending along side 42 of the rifle 32 and a second side 74, seen in FIG. 2, which is spaced-apart from the first side.

Referring back to FIG. 1, the rifle 32 further includes a handguard 76 which is operatively connected to and positioned above forestock 50. The handguard extends along the top 34 of the rifle 32 and is between the loading port 60 and muzzle end 40 of the rifle. The rifle includes a gas cylinder 78, in this example, which is coupled to and positioned forward of the handguard. A gas piston (not shown) is received within the gas cylinder.

The rifle 32 includes a front sight mechanism 80 in this example in the form of an annular member 82 extending upwards from the muzzle end 40 of the rifle.

Figure 9:
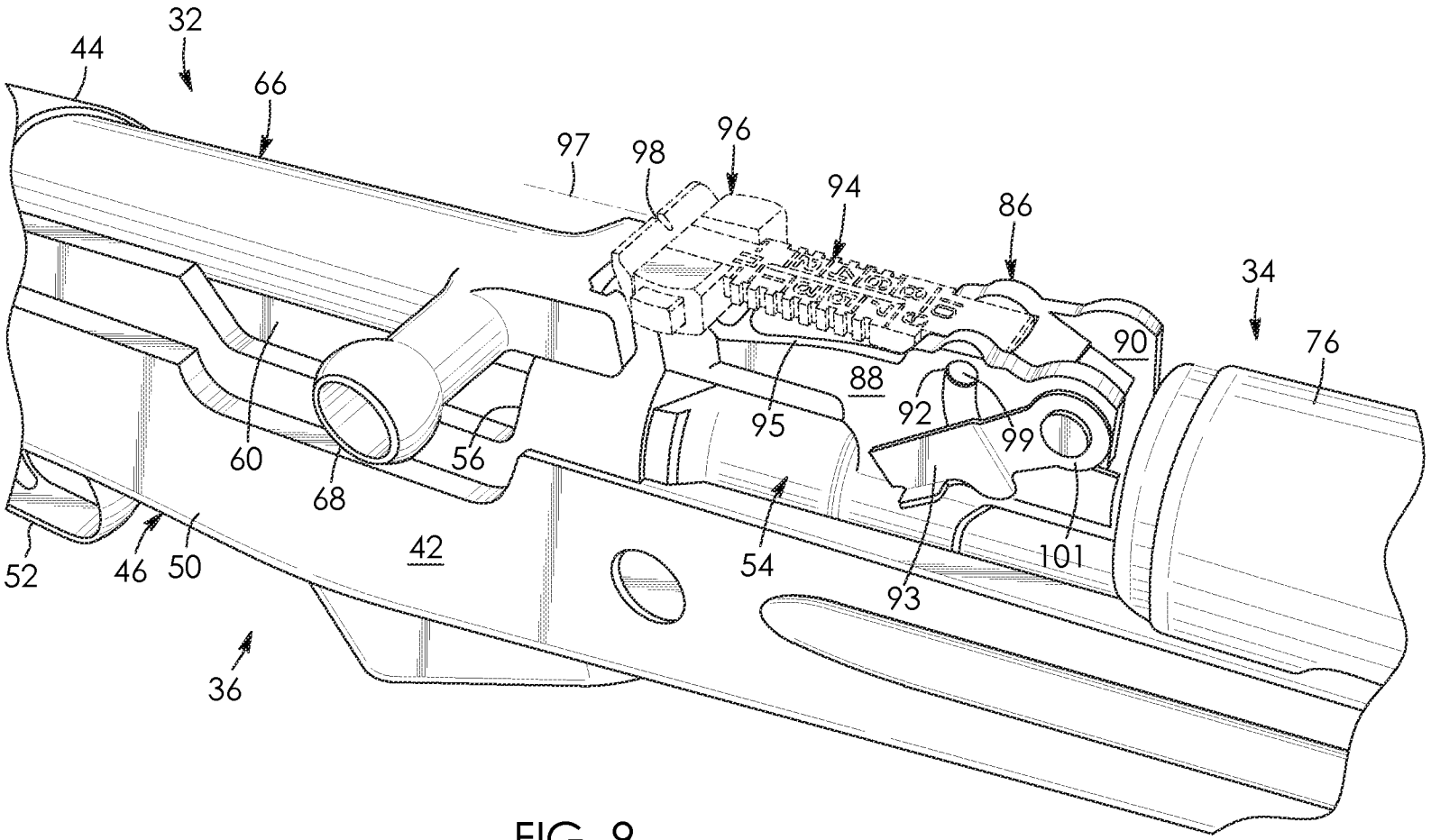
FIG. 9 (PRIOR ART)
FIG. 9 is a top, side perspective view of the rifle of FIG. 1 shown in fragment, with the rail system removed, and a rear sight mechanism of the rifle shown in ghost lines.

As best seen in FIG. 9, the rifle further includes a rear sight assembly 84 which is between the loading port 60 and handguard 76 of the rifle. The rear sight assembly may be referred to as a rear sight block and includes a rear sight receptacle 86 formed by a pair of spaced-apart plate-like side members 88 and 90 of the assembly. The side members align with and extend parallel with respective sides of the rifle, as seen by side member 88 extending parallel to side 42 of the rifle in FIG. 9. A pair of apertures extends through respective ones of the side members, as seen by aperture 92 for side member 88. A latch 93 pivotally connects to side member 88 via pivoting end 101 of the latch. The latch functions to selectively hold the handguard 76 and gas cylinder/piston assembly in place, as seen by gas cylinder 78 in FIG. 1. Referring back to FIG. 9, the side members 88 and 90 of the rear sight assembly 84 have a pair of upper peripheral edges which are downwardly-sloped towards the loading port 60 of the rifle in this example. This is seen by upper peripheral edge 95 for side member 88 in FIG. 9.

The rear sight assembly 84 includes a sight leaf 94 which is received by the receptacle 86. The sight leaf has a pair of outwardly-extending trunnions 99 shaped to fit within apertures 92 of the side members 88 and 90 of the receptacle 86 for selectively coupling the sight leaf to the side members. The sight leaf is shown in ghost lines in FIG. 9. Rifle 32 to this stage is conventional. A rear sight member 96 adjustably couples to and is moveable along the longitudinal axis 97 of the sight leaf and is also shown in ghost lines. The rear sight member has a downwardly-extending groove 98 functioning as a rear sight through which the user may sight for aiming the rifle 32.

Rifles per se, including their various parts and functionings, are well-known to those skilled in the art and therefore will not be described in further detail.

Figure 3:
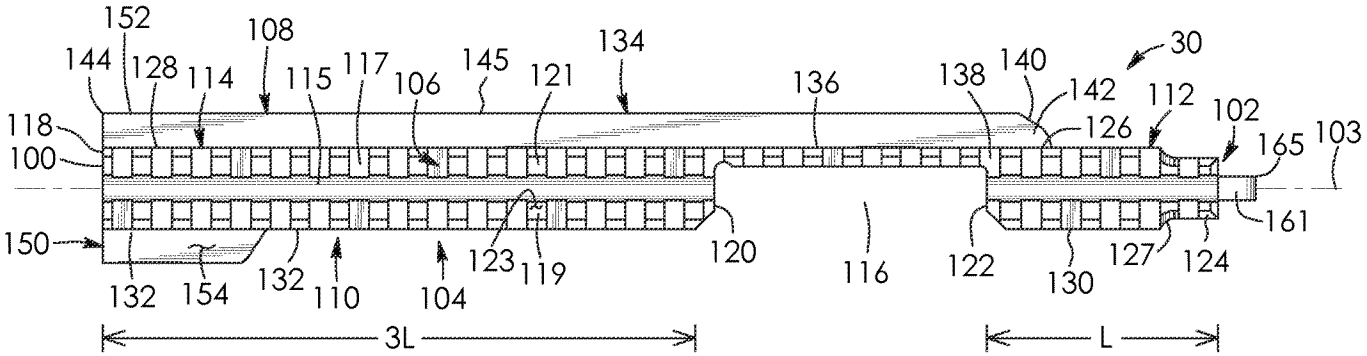
FIG. 3 is a top perspective view of the rail system of FIG. 1.
Figure 4:
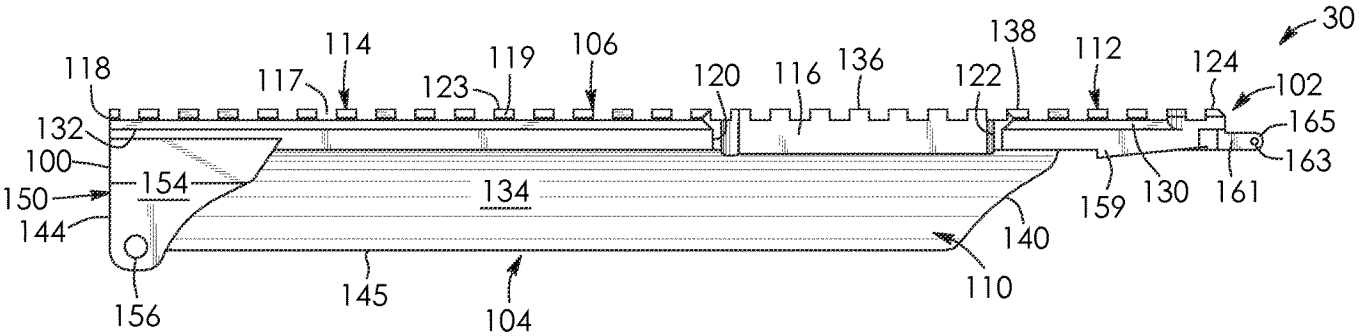
FIG. 4 is a first side elevation view of the rail system of FIG. 3.
Figure 5:
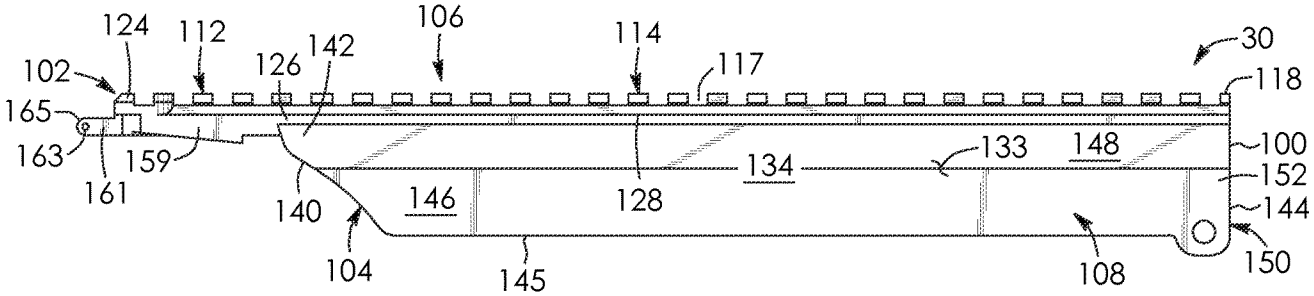
FIG. 5 is a second side elevation view of the rail system of FIG. 3.
Figure 6:
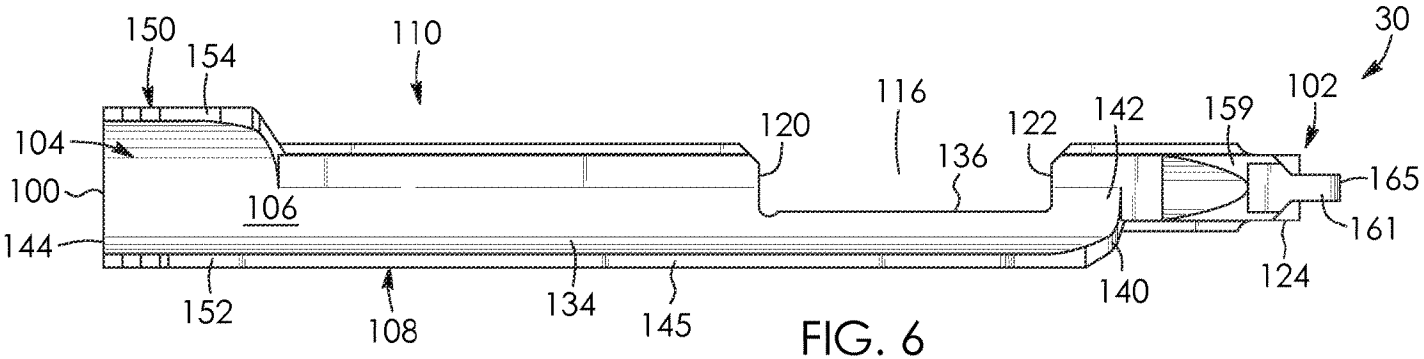
FIG. 6 is a bottom plan view of the rail system of FIG. 3.

As seen in FIG. 3, rail system 30 has a rearward end 100, a tapered forward end 102 spaced-apart from the rearward end and a longitudinal axis 103 extending between the rearward and forward ends. Referring to FIG. 6, the rail system has a substantially open bottom 104 and a substantially closed top 106 which is spaced-apart from the bottom. The top and the bottom of the rail system extend between ends 100 and 102 thereof. The rail system 30 has a pair of spaced-apart sides 108 and 110 extending between the ends thereof and extending between the bottom 104 and the top 106 of the system. Referring to FIG. 3, the longitudinal axis 103 of the system is located midway between the sides of the system. As seen in FIG. 5, a first one of the sides, in this example left side 108 being substantially closed. As seen in FIGS. 3 and 4, a second one of the sides, in this example right side 110 of the system is substantially open.

Referring to FIG. 3, the system includes a pair of spaced-apart top rails, namely a first top rail 112 and a second top rail 114 each of which extends along the top 106 of the system 30 and an aperture 116, between the top rails. The aperture is a rectangular prism in shape in this example. The rails 112 and 114 are substantially rectangular in shape when viewed from above in this example. The rails extend substantially parallel with each other and in parallel with the longitudinal axis 103 of the system in this example. Rail 112 has a length L and rail 114 has a length at least three times longer than rail 112 in this example. However, this is not strictly required and the rails may have other lengths in other examples.

Figure 7:
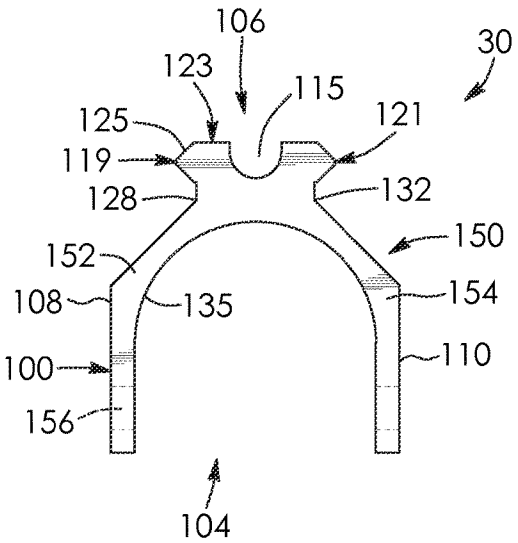
FIG. 7 is a rear elevation view of the rail system of FIG. 3.

Each of the rails has a centrally-positioned, longitudinally-extending groove, a plurality of longitudinally-spaced transversely-extending grooves intersecting perpendicular to the longitudinally-extending groove and two spaced-apart, longitudinally-arranged sets of protrusions interposed between said grooves. This is seen by longitudinally-extending groove 115, transversely-extending grooves 117 and sets 119 and 121 of protrusions for rail 114. Each of the protrusions is block-like in shape, with a rectangular-shaped top 123 and a peripheral portion 125 that is triangular in end profile, as seen in FIG. 7. The sets 119 and 121 of protrusions are connected to and integrally formed with the rest of respective rails in this example.

As seen in FIG. 1, a rifle accessory, in this example an optical scope 131 is selectively connectable to one of the rails, in this example rail 114. Rifle rails and optical scopes, including their various parts and functionings, are known per se and therefore will not be described in further detail.

Referring back to FIG. 3, rail 114 has a rearward end 118 which aligns with the rearward end 100 of the system 30 and has a forward end 120 which is adjacent to and rearward of aperture 116. Rail 112 has a rearward end 122 which is adjacent to and forward of aperture 116 and a tapered forward end 124 which is adjacent to the forward end 102 of the system 30. The width of the rail is reduced towards end 124 via a pair of spaced-apart rounded, inwardly-extending shoulders 127 in this example. As seen in FIG. 1, aperture 116 of the rail system is shaped to align and be coextensive with the loading port 60 of the system. Rail 112 is thus forward of the loading port and rail 114 is rearward of the loading port when the system 30 is connected to the rifle 32.

As seen in FIG. 3, the rails 112 and 114 have left side peripheral portions 126 and 128, respectively, and right side peripheral portions 130 and 132, respectively, which are spaced-apart from their left side peripheral portions. The peripheral portions 126 and 130 of rail 112 extend from rearward end 122 to forward end 124 of the rail. The peripheral portions 128 and 132 of rail 114 extend from rearward end 118 to forward end 120 of the rail. Each of the peripheral portions extends parallel with the longitudinal axis 103 of the system 30. As seen in FIG. 7, the peripheral portions 128 and 132 of the rails are adjacent to and are positioned below the sets of protrusions 119 and 121 of the rails.

Figure 8:
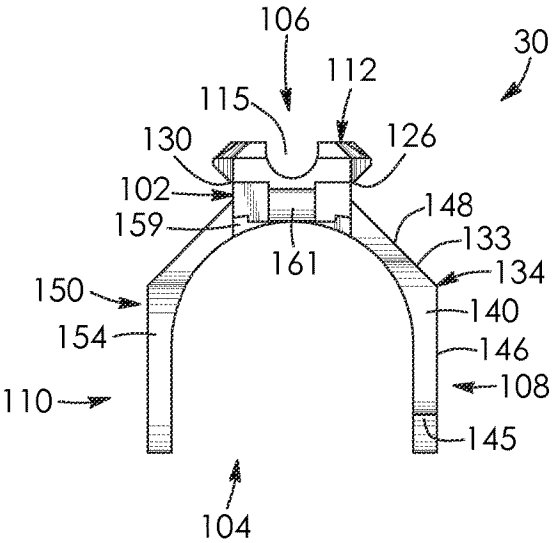
FIG. 8 is a front elevation view of the rail system of FIG. 3.

As best seen in FIG. 5, the system 30 further comprises an elongate side member 134 which couples to and extends downwards from the left side peripheral portions 126 and 128 of the rails 112 and 114. The side member extends substantially along the left side 108 of the rail system and the left side of the system thus connects the rails together. The side member 134 is generally rectangular in side profile. As seen in FIG. 8, the side member is longitudinally angled, with an outer surface 133 which is outwardly facing and generally outwardly-convex in this example. The side member further includes an inner surface 135 which is spaced-apart from the outer surface. The inner surface 135 of the side member 134 is inwardly facing and is concave-shaped in this example for receiving top side portions 137 of side 74 of top cover 70 of the rifle 32 seen in FIG. 2.

Referring now to FIG. 5, the side member 134 has an upper peripheral edge 136 which is connected to the peripheral portion 128 of the second rail 114. As seen in FIG. 3, the upper peripheral edge 136 of the side member also connects to a rearward portion 138 of the first rail 112 in this example located adjacent to rearward end 122 of the first rail. As seen in FIG. 3, aperture 116 is in communication with and extends between forward end 120 of rail 114, rearward end 122 of rail 112 and that part of the side member 134 which extends between the rails 112 and 114.

As seen in FIG. 5, the side member 134 has a tapered front end 140, an upper portion 142 of which couples to and extends downwards from the first rail 112. The side member has a rearward end 144 that aligns with the rearward end 100 of the rail system 30 in this example. The side member 134 has a lower peripheral edge 145 which is spaced-apart below the upper peripheral edge 136 thereof. The upper peripheral edge of the side member is longer than the lower peripheral edge of the side member. As seen in FIG. 3, the upper peripheral edge 136 and the lower peripheral edge 145 of the side member 134 extend parallel with the longitudinal axis 103 of the system 30 in this example.

As seen in FIG. 2, the side member 134 includes a first longitudinal portion 146 which is shaped to extend along and in parallel with left side 44 of the rifle 32. The first longitudinal portion of the side member extends between ends 140 and 144 thereof and extends substantially perpendicular to the rails 112 and 114 in this example. As seen in FIG. 5, the first longitudinal portion 146 of the side member 134 extends upwards from the lower peripheral edge 145 of the side member. The side member 134 includes a second longitudinal portion 148 which couples the first longitudinal portion 146 of the side member and the rails 112 and 114 together. The longitudinal portions 146 and 148 are generally rectangular in side profile and extend parallel with the longitudinal axis 103 of the rail system 30 seen in FIG. 3. Referring back to FIG. 5, the second longitudinal portion of the side member extends between ends 140 and 144 thereof and is angled relative to the rails and the first longitudinal portion 146 of the side member. The second longitudinal portion 148 of the side member 134 extends downwards from the upper peripheral edge 136 of the side member.

As seen in FIG. 3, the rail system 30 further includes a rear mounting bracket 150 coupled to and extending outwards from the second rail 114. Referring to FIG. 7, the bracket is u-shaped in this example and comprises a pair of spaced-apart angled side portions 152 and 154. Left side portion 152 is connected to and is integrally formed with the rearward end 144 of the side member 134, as seen in FIGS. 2 and 7. As seen in FIG. 3, right side portion 154 of the bracket 150 is generally trapezoidal in side profile in this example. Referring back to FIG. 7, a pair of apertures extends through side portions 152 and 154 of the bracket 150, as seen by aperture 156 for side portion 152. The rear mounting bracket is selectively connectable to top side portions of the rifle. A pair of fasteners, in this example screws as seen by screw 158 in FIG. 2, extends through the apertures 156 of the bracket 150 and selectively couple to respective sides 44 of the rifle for coupling the rear mounting bracket to the rifle 32.

As seen in FIG. 10, the tapered forward end 102 of the rail system 30 is connectable with the rear sight assembly 84 upon sight leaf 84 seen in FIG. 9 being removed. As seen in FIG. 3, the tapered forward end 102 of the rail system 30 comprises the forward end of rail 112 which is inwardly tapered relative to the rest of the rail. As seen in FIG. 10, the rail 112 so shaped enables latch 93 to selectively move upwards or downwards, as seen by arrow of numeral 157, without being impeded by the forward end 124 of the rail.

As seen in FIG. 3, the tapered forward end 102 of the rail system 30 further comprises a protruding portion 161 which couples to and extends from the forward end 124 of rail 112. The protruding portion 161 is generally in the shape of a rectangular prism in this example and aligns and extends parallel to the longitudinal axis 103 of the rail system 30. As seen in FIG. 4, an aperture 163 extends through the protruding portion of the forward end of the rail system. The aperture is positioned perpendicular to the longitudinal axis 103 of the system 30 seen in FIG. 3 in this example. The distal end 165 of protruding portion 161 is rounded in this example. As seen in FIG. 10, protruding portion 161 of the forward end 102 of the rail system is shaped to fit within the rear sight receptacle 86 between side members 88 and 90 thereof. A pin 160 extends through the apertures 92 of the side members of the receptacle and aperture 163 of the protruding portion 161 seen in FIG. 4 for coupling the forward end of the system to the rifle. As seen in FIG. 10, the tapered forward end 102 of the system 30 has a bottom 159 that is wedge-shaped in side profile and which extends downwards from rail 112. Bottom 159 is shaped to abut and rest upon upper peripheral edges 95 of the side members 88 of the rear sight assembly 84.

Still referring to FIG. 10, a stripper clip 162 holds together a plurality of cartridges or bullets 62 as a single unit. Aperture 116 of the rail system 30 is shaped to receive the stripper clip therethrough. The stripper clip extends through aperture 116 and into the loading port 60 of the rifle 32 for inserting bullets within the magazine assembly 64.

FIGS. 11 to 18 show another rail system 30.1 for the rifle 32 of FIGS. 1 to 10, with rail system 30.1 being according to a second aspect. Like parts have like numbers and functions as the rail system 30 shown in FIGS. 1 to 10 with the addition of decimal extension ".1". Rail system 30.1 is substantially the same as rail system 30 shown in FIGS. 1 to 10 with the following exceptions.

Figure 13:
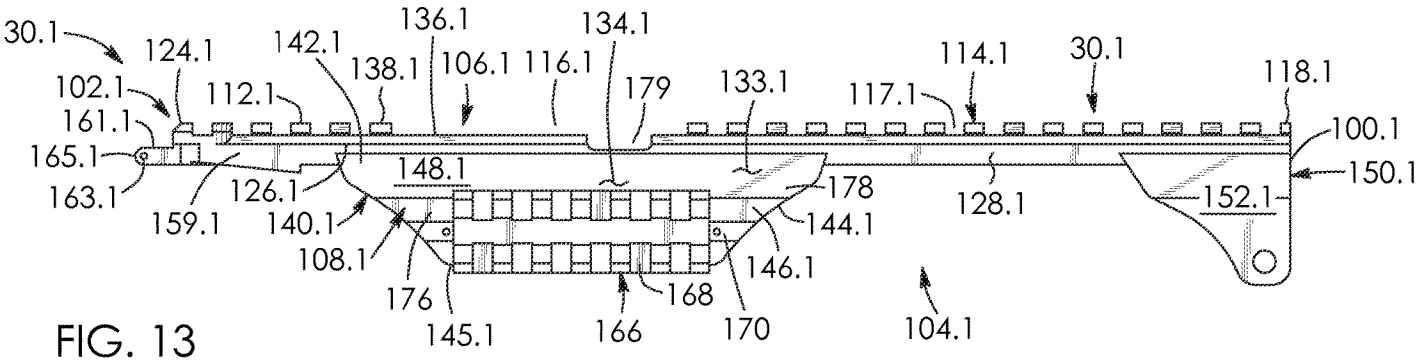
FIG. 13 is a second side elevation view of the rail system of FIG. 11, the rail system having a side rail.
Figure 14:
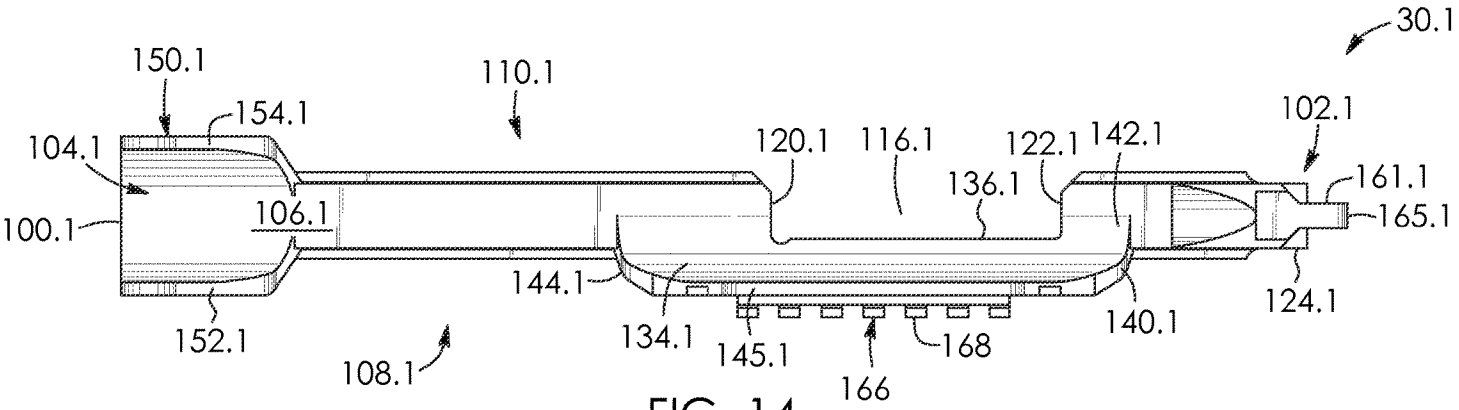
FIG. 14 is a bottom plan view of the rail system of FIG. 11.
Figure 16:
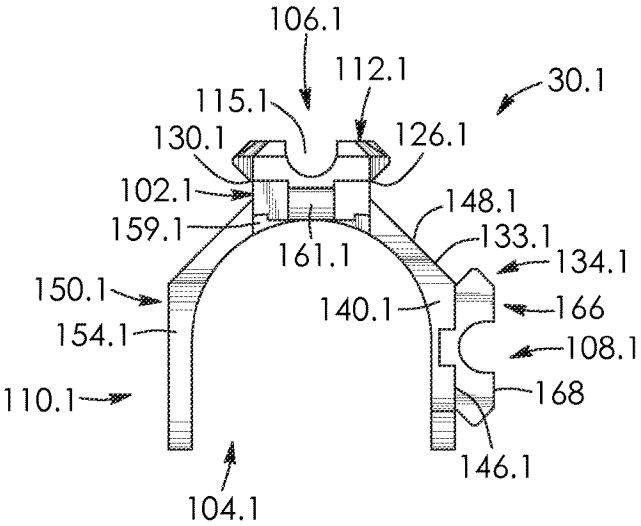
FIG. 16 is a front elevation view of the rail system of FIG. 11.
Figure 15:
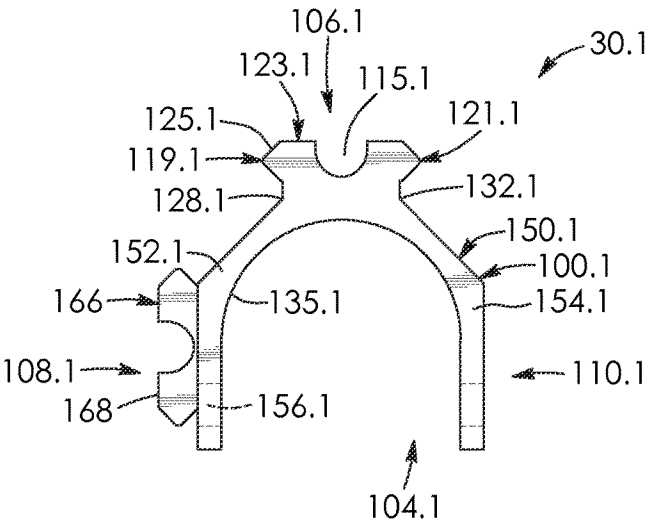
FIG. 15 is a rear elevation view of the rail system of FIG. 11.
Figure 17:
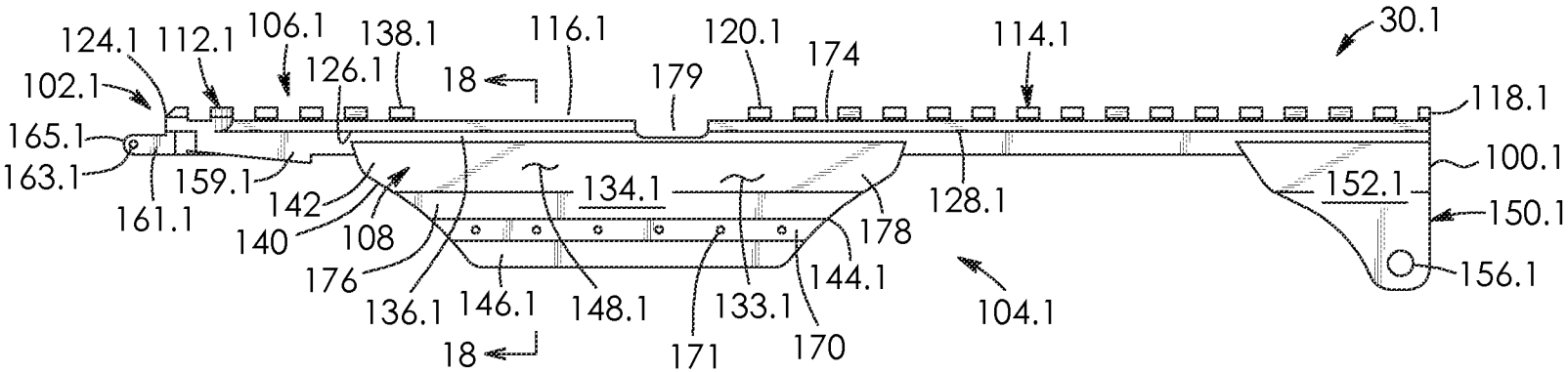
FIG. 17 is a second side elevation view of the rail system of FIG. 13, with the side rail being removed.
Figure 18:
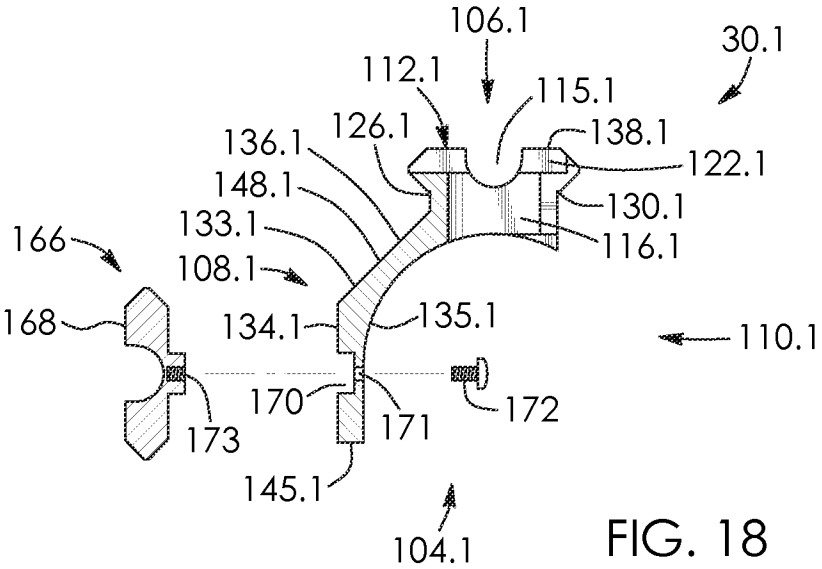
FIG. 18 is a sectional, exploded view of the rail system of FIG. 17 taken along lines 18-18 of FIG. 17, with the side rail in the process of being connected to a side member of the rail system.

As seen in FIG. 13, side member 134.1 of the rail system 30.1 has a side rail 166 thereon. The side rail is substantially interposed between and perpendicular to the first rail 112.1 and second rail 114.1. As seen in FIG. 18, the rail 166 in this example comprises a plurality of portions 168 that are selectively insertable within a longitudinally-extending groove 170 of the side member 134.1 seen in FIG. 17. As seen in FIG. 17, the side member 134.1 includes a plurality of longitudinally spaced-apart apertures 171 which extend therethrough from side 108.1 of the system 30.1 towards side 110.1 of the system seen in FIG. 18. Referring back to FIG. 17, the apertures are in communication with and extend through groove 170 in this example. As seen in FIG. 18, the portions 168 of the side rail 166 couple to the side member 134.1 via fasteners, in this example bolts 172. The bolts are inserted partially through apertures 171 via side 110.1 of the system 30.1 and threadably connect to corresponding threaded apertures 173 of portions 168 of the side rail seen in FIG. 18.

As seen in FIG. 17, the side member 134.1 extends between rearward portion 138.1 of the first rail 112.1 and a forward portion 174 of the second rail 114.1. The forward portion of the second rail is adjacent to the forward end 120.1 of the rail.

Side member 134.1 further includes a pair of spaced-apart flanges 176 and 178 that are trapezoidal in shape in side profile in this example. As seen in FIG. 13, side rail 166 is between the flanges. The flange 176 extends between the side rail and first rail 112.1. Flange 178 extends between the side rail 166 and second rail 114.1. Flange 176 aligns with the forward end 140.1 of the side member 134.1 and flange 178 aligns with the rearward end 144.1 of the side member. One or more further accessories (not shown) may selectively connect to the side rail.

Figure 12:
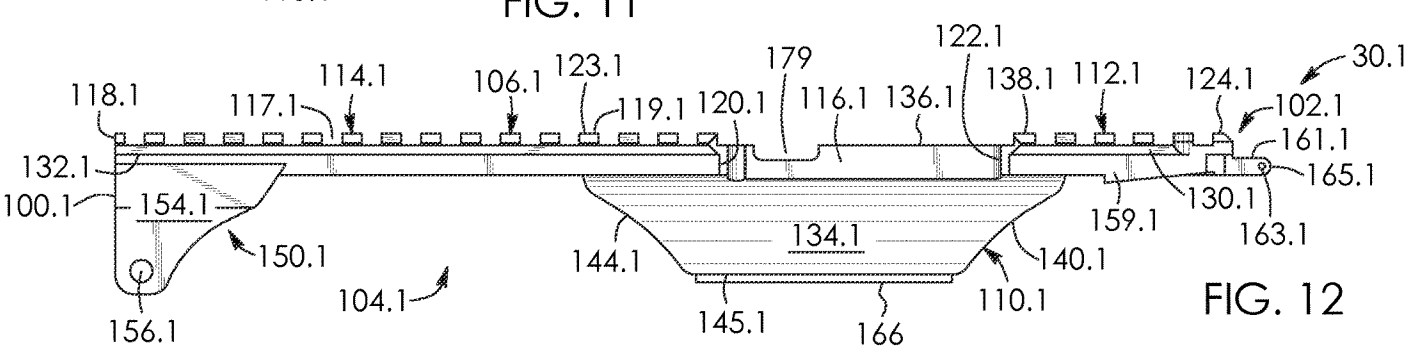
FIG. 12 is a first side elevation view of the rail system of FIG. 11.

As seen in FIG. 12, side member 134.1 includes a recess 179 extending downwards from the upper peripheral edge 136.1 of the side member. The recess may be referred to as a thumb cut-out. Recess 179 is interposed between rails 112.1 and 114.1 and is positioned adjacent to forward end 120.1 of rail 114.1 in this example. Recess 179 is in communication with aperture 116.1 and is generally u-shaped in this example. The recess is shaped to facilitate loading of bullets into the loading port of the rifle via one's left thumb. The recess 179 enables the left thumb of the user to travel further downwards into aperture 116.1 while pushing the rounds in the stripper clip into the rifle.

FIGS. 19 to 22 show another rail system 30.2 for the rifle 32 of FIGS. 1 to 10, with rail system 30.2 being according to a third aspect. Like parts have like numbers and functions as the rail system 30.1 shown in FIGS. 11 to 18 with decimal extension ".2" replacing decimal extension ".1" and being added for numerals not previously having a decimal extension. Rail system 30.2 is substantially the same as rail system 30.1 shown in FIGS. 11 to 18 with the following exceptions.

Figure 19:
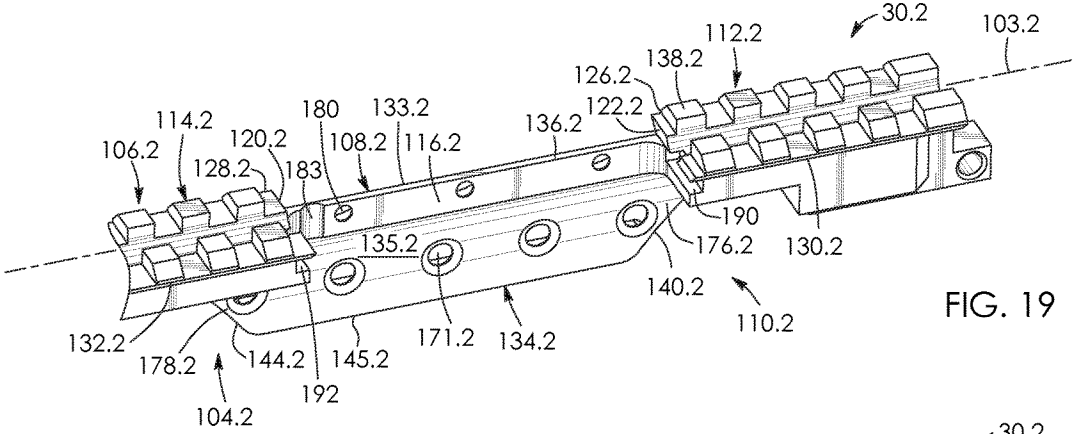
FIG. 19 is a top, first side perspective view of a rail system show in fragment, the rail system being according to a third aspect, the rail system having first and second top rails, a side rail (not shown) and an insertable third rail (not shown)
Figure 22:
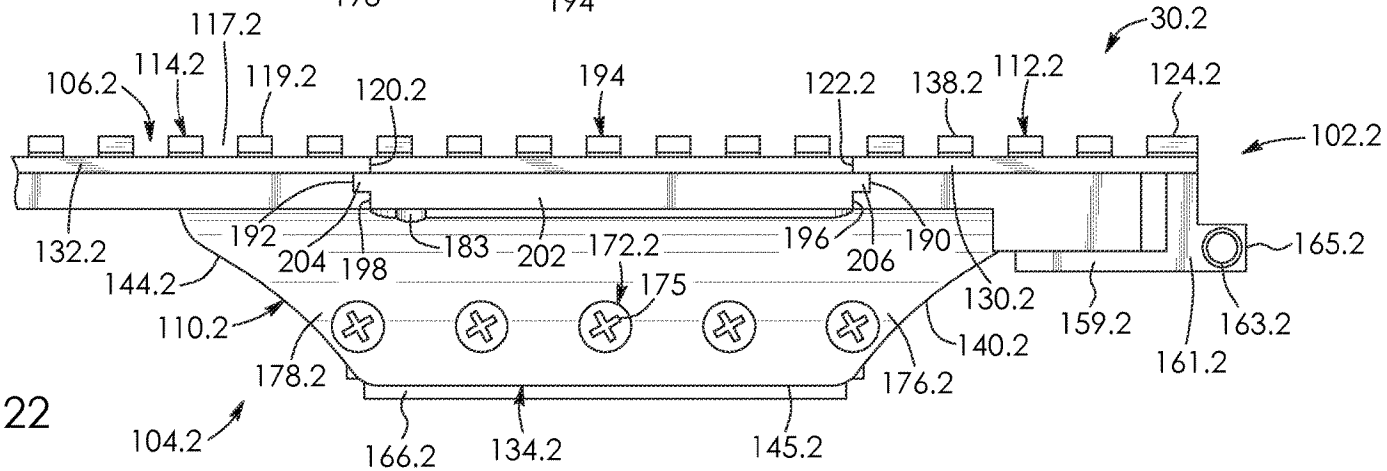
FIG. 22 is a first side elevation view of the rail system of FIG. 21, with the third rail shown connected to the first and second rails.

Referring to FIG. 19, apertures 171.2 of the side member 134.2 are tapered in this example as the apertures extend from the inner surface 135.2 of the side member to the outer surface 133.2 of the side member. Referring to FIG. 22, bolts 172.2 have tapered heads 175. The bolts couple side rail 166.2 to side member 134.2 in a manner which ensures that heads 175 of the bolts are substantially flush with inner surface 135.2 of the side member.

Distal end 165.2 of protruding portion 161.2 of the forward end 102.2 of the rail system 30.2 is flat and rectangular in front profile in this example. Bottom 159.2 of the end 102.2 of the system is flat and generally in the shape of a rectangle in side profile in this example.

Figure 21:
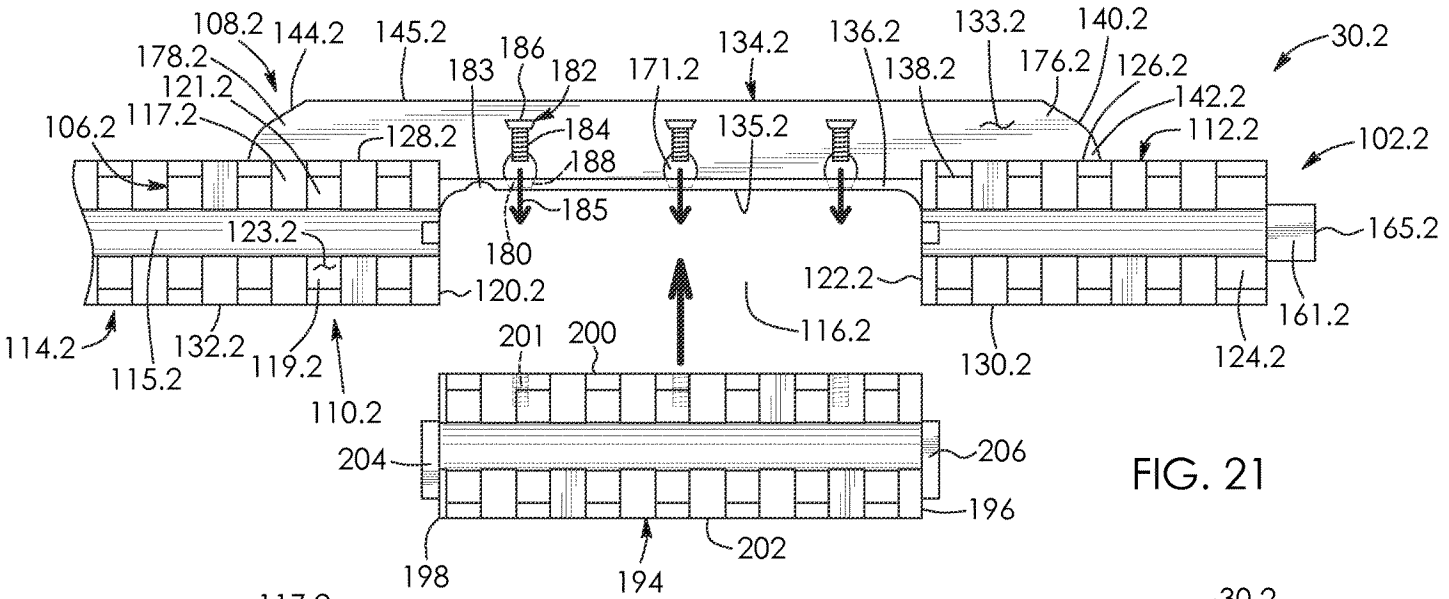
FIG. 21 is a top plan exploded view of the rail system of FIG. 19, with the third rail being shown in the process of being inserted between the first and second rails.

As seen in FIG. 21, side member 134.2 has a downwardly extending groove 183 that is u-shaped in top profile in this example. The groove extends inwards from inner surface 135.2 of the side member towards outer surface 133.2 of the side member. Groove 183 also extends from top 106.2 of the system 30.2 and upper peripheral edge 136.2 of the side member 134.2 towards bottom 104.2 of the system as seen in FIG. 22 in this example. The groove is positioned adjacent to forward end 120.2 of rail 114.2 in this example and is shaped to function as a guide for stripper clips, such as stripper clip 162 seen in FIG. 10.

Figure 20:
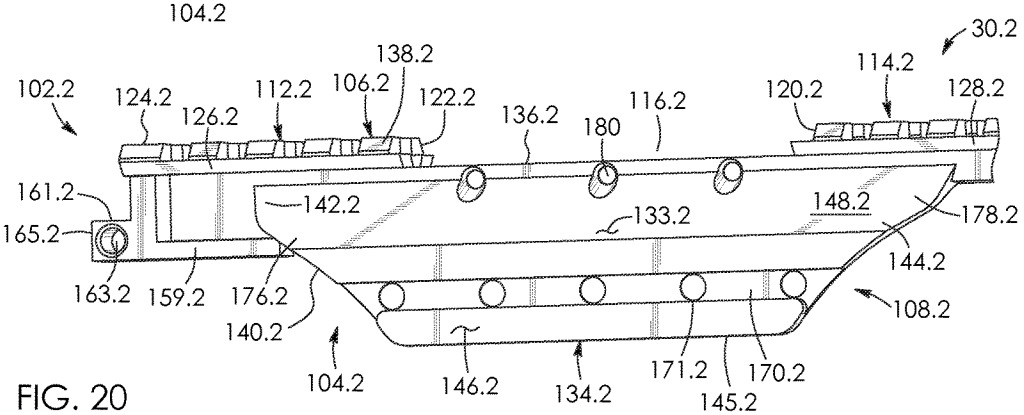
FIG. 20 is a second side perspective view of the rail system of FIG. 19, the rail system being shown in fragment.

Referring to FIG. 20, side member 134.2 has a plurality of longitudinally spaced-apart apertures 180 extending therethrough at locations adjacent to upper peripheral edge 136.2 of the side member. The apertures extend between first rail 112.2 and second rail 114.2 and are in communication with aperture 116.2 of the rail system 30.2. Referring to FIG. 21, each of the apertures 180 extends from left side 108.2 towards right side 110.2 of the system. As seen in FIG. 20, each of the apertures 180 is tapered inwardly as it extends from the left side to the right side of the system.

Referring to FIG. 21, the system 30.2 further includes a plurality of connectors, in this example in the form of tapered bolts 182. The bolts have elongate shafts 184 shaped to extend through respective ones of the apertures 180. The insertion of the bolts 182 into the apertures is indicated by arrow of numeral 185. The bolts have tapered heads 186 coupled to the shafts 184. The tapered heads are shaped to abut portions 188 adjacent to the apertures 180. This ensures that the tapered heads of the bolts 182 lay substantially flush with the outer surface 133.2 of the side member 134.2 when the bolts are fully inserted into the side member.

As seen in FIG. 19, first rail 112.2 has an elongate groove 190 in this example at rearward end 122.2 thereof. The groove is u-shaped in side profile in this example. Groove 190 is positioned adjacent to peripheral portions 126.2 and 130.2 of the rail 112.2 and extends from right side 110.2 towards left side 108.2 of the rail system 30.2. The groove faces and is in communication with aperture 116.2 of the rail system.

Second rail 114.2 has an elongate groove 192 at forward end 120.2 thereof. The groove is u-shaped in side profile in this example. Groove 190 is positioned adjacent to peripheral portions 128.2 and 132.2 of the rail 114.2 and extends from right side 110.2 towards left side 108.2 of the rail system 30.2. The grooves 190 and 192 face each other in this example. Groove 192 faces and is in communication with aperture 116.2 of the rail system 30.2.

As seen in FIG. 21, the rail system includes a removable third rail, in this example top rail 194. The rail is shaped to selectively cover aperture 116.2 of the system and thus the loading port of the rifle, such as loading port 60 seen in FIG. 9. The third rail 194 may be referred to as a rail insert.

Referring back to FIG. 21, rail 194 is substantially rectangular in top profile in this example and is also substantially rectangular in side profile, as seen in FIG. 22. The rail has a forward end 196 and a rearward end 198 spaced-apart from the forward end. Rail 194 is shaped such that the distance between its ends substantially corresponds to the distance of separation between rails 112.2 and 114.2.

The rail has a left side peripheral portion 200 alignable with side 108.2 of the rail system 30.2. The rail 194 has a right side peripheral edge portion 202 alignable with side 110.2 of the system. The peripheral portions of rail 194 extend between ends 196 and 198 of the rail in this example. A plurality of longitudinally spaced-apart threaded apertures 201 extend into the left side peripheral portion 200 of the rail. Apertures 201 are shown in ghost in FIG. 21 and are positioned to be alignable with apertures 180 of the side member 134.2.

Referring to FIGS. 21 and 22, rail 194 includes a pair of spaced-apart male members 204 and 206 which extends outwards from the ends 196 and 198 of the rail. Each of the male members is in the shape of a rectangular prism in this example. The male members 204 and 206 are shaped to fit within the elongate grooves 190 and 192 of the rails 112.2 and 114.2 seen in FIG. 22 for selectively inserting and coupling the third rail 194 to the first and second rails thereby.

Referring to FIG. 21, left side peripheral portion 200 of rail 194 abuts inner surface 135.2 of the side member 134.2 adjacent to upper peripheral edge 136.2 of the side member upon rail 194 being fully inserted in place between rails 112.2 and 114.2. Thereafter, bolts 180 are insertable through apertures 180 and 201 for selectively further connecting rail 194 to side member 134.2, as seen in FIG. 22. Rail 194 may function as a shell deflector and effectively converts system 30.2 to a full length top rail comprising rails 112.2, 194 and 114.2.

It will be appreciated that many variations are possible within the scope of the invention described herein. For example, while rail 194 is shown with male members 204 and 206 in FIG. 21 that are slidably insertable within grooves 190 and 192 of rails 112.2 and 114.2 seen in FIG. 22, in the alternative, rails 112.2 and 114.2 may have outwardly extending male members that selectively couple with corresponding inwardly-extending grooves of rail 194.

It will be understood by someone skilled in the art that many of the details provided above are by way of example only and are not intended to limit the scope of the invention which is to be determined with reference to at least the following claims.

What is claimed is:

1. A rail system selectively connectable to a rifle, the rifle having a side and having a loading port for receiving cartridges therein, and the system comprising:

a first rail positioned forward of the loading port;

a second rail extending substantially parallel to the first rail and being positioned rearward of the loading port, the first rail and the second rail being top rails;

an aperture interposed between the first rail and the second rail, the aperture being positioned to align with the loading port;

an elongate side member connecting together the first rail and the second rail, the elongate side member being shaped to extend along the side of the rifle; and a side rail coupled to and extending outwards from the side member, the side rail being positioned below said aperture.

2. The system as claimed in claim 1, the rifle having a rear sight block and wherein the system has a tapered forward end which is connectable with the rear sight block.

3. The system as claimed in claim 1, the rifle having a rear sight receptacle, wherein the system has a tapered forward end shaped to be received by said receptacle and wherein the system further includes a rear mounting bracket coupled to and extending outwards from the second rail, the rear mounting bracket being selectively connectable to top side portions of the rifle.

4. The system as claimed in claim 1 wherein the side member has an upper peripheral edge coupled to the second rail and coupled to a rearward portion of the first rail.

5. The system as claimed in claim 1 wherein the side member has a tapered front end, an upper portion of which couples to and extends from the first rail.

6. The system as claimed in claim 1 wherein the side member extends between a rearward portion of the first rail and a forward portion of the second rail.

7. The system as claimed in claim 1 wherein the side rail is positioned between the first rail and the second rail and is perpendicular to the first rail and the second rail.

8. The system as claimed in claim 1 wherein the side member includes an upper peripheral edge extending between the first rail and the second rail and a recess extending downwards from said upper peripheral edge, the recess being in communication with said aperture and being shaped to facilitate loading of the cartridges in the loading port.

9. In combination, a rifle and the system as claimed in claim 1.

10. The system as claimed in claim 1 wherein the side member is trapezoidal in shape.

11. The system as claimed in claim 1 wherein the aperture is shaped to receive a stripper clip therethrough when the rail system is coupled to the rifle.

12. In combination, a rifle accessory and the system as claimed in claim 1, the rifle accessory being selectively connectable to one of said rails.

13. The combination as claimed in claim 12, wherein the rifle accessory is an optical scope.

14. A rail system selectively connectable to a rifle, the rifle having a loading port for receiving cartridges therein, and the system comprising:

a first rail positioned forward of the loading port;

a second rail extending substantially parallel to the first rail and being positioned rearward of the loading port;

an aperture interposed between the first rail and the second rail, the aperture being positioned to align with the loading port of the rifle;

an elongate side member connecting together the first rail and the second rail; and a removable third rail selectively insertable between the first rail and the second rail, the third rail being shaped to selectively cover the loading port.

15. The system as claimed in claim 14 wherein the side member has a plurality of longitudinally spaced-apart apertures and wherein the system further includes a plurality of connectors which extend through said apertures of the side member and selectively couple the third rail to the side member.

16. The system as claimed in claim 14, wherein the first rail and the second rail are top rails, wherein the system includes a pair of sides, the side member extending along a first one of the sides, a second one of the sides being substantially open, wherein the side member has a plurality of longitudinally spaced-apart apertures, wherein the system includes a side rail, and wherein the system includes a plurality of fasteners inserted partially through respective ones of the apertures of the side member via the open side of the system, the fasteners threadably connecting to corresponding threaded apertures of the side rail, the side rail coupling to and extending outwards from the side member thereby.

17. A rail system selectively connectable to a rifle, the rifle being shaped to receive a stripper clip and having a loading port for receiving cartridges therein, and the system comprising:

a first rail positioned forward of the loading port;

a second rail extending substantially parallel to the first rail and being positioned rearward of the loading port;

an aperture interposed between the first rail and the second rail, the aperture being positioned to align with the loading port; and an elongate side member connecting the rails together, the side member having an inner surface in communication with the aperture, an outer surface spaced-apart from the inner surface and a downwardly-extending groove in communication with the aperture, the groove extending from the inner surface of the side member towards the outer surface of the side member and being shaped to facilitate guiding the stripper clip into the loading port.

18. The system as claimed in claim 17 wherein the system has a rearward end and a forward end which is spaced-apart from the rearward end, wherein the first rail has a rearward end adjacent to the aperture of the system and a forward end which corresponds to the forward end of the system, and wherein the side member extends from the rearward end of the system to the rearward end of the first rail.

19. A rail system selectively connectable to a rifle, the rifle having a loading port for receiving cartridges therein, and the system comprising:

a first rail positioned forward of the loading port, the first rail including an elongate groove at a rearward end thereof;

a second rail extending substantially parallel to the first rail and being positioned rearward of the loading port, the second rail including an elongate groove at a forward end thereof;

an aperture interposed between the first rail and the second rail, the aperture being positioned to align with the loading port;

an elongate side member connecting together the first rail and the second rail; and a removable third rail selectively insertable between the first rail and the second rail, the third rail having a pair of spaced-apart ends and including a pair of spaced-apart male members extending outwards from said ends of the third rail, the male members being shaped to fit within respective ones of said elongate grooves for coupling the third rail to the first rail and the second rail thereby.

20. A rail system selectively connectable to a rifle, the rifle having a loading port for receiving cartridges therein, and the system comprising:

a first rail positioned forward of the loading port;

a second rail extending substantially parallel to the first rail and being positioned rearward of the loading port, the first rail and the second rail being top rails;

an aperture interposed between the first rail and the second rail, the aperture being positioned to align with the loading port;

an elongate side member connecting together the first rail and the second rail, the elongate side member being shaped to extend along the side of the rifle;

a side rail; and a plurality of fasteners which couple the side rail to the side member in a manner which ensures that heads of the fasteners are substantially flush with an inner surface of the side member.

* * * * *